US005918779A

United States Patent [19]

Ventura

[11] Patent Number: 5,918,779

[45] Date of Patent: Jul. 6, 1999

[54] VALUE ASSEMBLY FOR SUPPLYING PRESSURIZED LIQUID FROM A CONTAINER

[75] Inventor: Francisco Juan Ventura, Buenos Aires, Argentina

[73] Assignee: Haiger International S.A., Montevideo, Uruguay

[21] Appl. No.: 09/140,321

[22] Filed: Aug. 26, 1998

[30] Foreign Application Priority Data

Aug. 26, 1997 [AR] Argentina ..... P97 01 03879

[51] Int. Cl.[6] ..... B07D 5/06

[52] U.S. Cl. ..... 222/402.1; 222/518

[58] Field of Search ..... 222/212, 402.1, 222/518

[56] References Cited

U.S. PATENT DOCUMENTS 2,543,850 3/1951 Henricson ..... 222/518

4,660,748 4/1987 Hagan ..... 222/518

5,299,718 4/1994 Shwery ..... 222/518

*Primary Examiner*—Philippe Derakshani

*Attorney, Agent, or Firm*—Jacobson, Price, Holman & Stern, PLLC

[57] ABSTRACT

A valve assembly for use in containers for pressurized liquids, such as siphon bottles, wherein the container and the valve assembly are disposable, the valve assembly comprising a body with an inner resilient closing piece seating against a valve seat, the closing valve being actuated from an user pressing onto a dome-cap closing a top opening of the body, the top opening, without the cap, allowing the carrying out of a refilling process which, in turn, may be carried out after an complete cleaning of the outer and inner surfaces of the container.

9 Claims, 1 Drawing Sheet

VALUE ASSEMBLY FOR SUPPLYING PRESSURIZED LIQUID FROM A CONTAINER

BACKGROUND OF THE INVENTION

1. Field of the Invention

The present invention relates to a valve assembly for supplying a liquid from a container, the liquid being contained under pressurized conditions in the container. The invention also refers to a method for filling such container with liquid to be supplied from the container. More particularly, the invention refers to a valve assembly for a siphon bottle and the method is a continuous process for filling these siphon-containers which process, as compared to the conventional containers and filling methods, allows the container, before the filling steps, to be open, that is without the valve assembly fixed on a mouth of the container, so that the filling process may be easy to be carried out and the inner volume of container can be washed before filling the same with the liquid.

2. Description of the Prior Art

It is well known in the art to provide valve assemblies to supply gaseous liquids, bottled under pressure, such as in siphon bottles. All of them, however, consist of plastic or glass bottles including a valve head or assembly that is permanently fixed to the bottle and the assembly is not removed during the process of refilling the bottle.

These known plastic or glass siphon bottles are of the returning type, that is, from the consumer's home the bottles are returned to the bottling plant wherein the bottles are externally washed and taken by a refilling machine that takes the bottles, put them upside down and connect the valve assemblies to a refilling nozzle to refill the bottle with water under pressure to keep the liquid in a gaseous and pressurized condition during storage. Upon refilling, the valve means in the valve assembly yield upon the pressure of the injected liquid and open to allow the liquid to enter the siphon bottle and remain in the bottle under pressure until it is driven out by the user. As it is clear from the above description, however, the inner volume of the siphon bottles are not washed under the erroneous assumption that this is not necessary because the valve head or assembly prevent any particle or foreign matter from entering the bottle once the siphon bottle has been emptied and await for being returned to the bottling plant. However, many foreign matter, harmful and toxic substances, have been unfortunately found in the bottles returned to the bottling plant, perhaps due to inadvertent actions or intentionally, by competitors, for example.

Furthermore, the known valve head or assemblies are generally complex and heavy assemblies, also made from combined plastics and metals having many drawbacks such as little continuous leakage, bad functioning of the valve actuating levers, which, many times, causes part of the liquid to remain in the bottles without being entirely removed from the bottle, or causes the liquid to leak out of the bottle during storage in the bottling plant or, worst, in the consumer's home. Furthermore, the conventional valve heads or assemblies are very expensive at such an extent that the cost thereof in the total cost of the siphon bottle is very important and this caused, among other things, that the siphon bottles are of the returning type.

It would be therefore convenient to have a valve assembly by means of which a disposable, simple and cheap siphon bottle may be obtained, the valve assembly being simple, safe and reliable and, in the event the bottles are of the "to return" type, being suitable to carry out a novel procedure to refill siphon bottles wherein the bottles can be cleaned not only outside thereof but also in the inner volume of same. It is to be remarked that, with conventional valve assemblies, no inner washing of the bottles are carried out because it would be very complex and expensive to remove the valve assemblies from the bottles returned from the user's homes and the bottles are only washed in the outer surfaces thereof in the assumption that no dirt enters the inner volume of the volumes. The conventional filling machines take the siphons to refill the same through the siphon spouts with the valve assembly fixed in the container. If the washing of the inner volume would be desired to be carried out in the conventional filling plants it would be necessary to remove the valve assemblies from the containers, wash the interior of the containers and refit the valve assemblies to proceed with the refilling of the bottles.

SUMMARY OF THE INVENTION

In view of the foregoing it is an object of the invention to provide a valve assembly for use in containers for pressurized liquids, such as siphon bottles, wherein the container and are disposable, due to their lower cost, the valve assembly comprising a body with an inner resilient closing piece seating against a valve seat, the closing valve being actuated from an user pressing onto a dome-cap closing a top opening of the body, the top opening, without the cap, allowing the carrying out of a refilling process which, in turn, may be carried out after an complete cleaning of the outer and inner surfaces of the container.

It is still another object of the present invention to provide a valve assembly for supplying pressurized liquid from a container, the assembly being of the type comprising a body capable of being sealably fixed to a neck of the container, a socket holding a dip tube extending to a bottom of the container to allow the liquid to be driven out by the pressure of the gas within the container and a valve member capable of being operated by an user to open a path for said liquid through the dip tube towards a supplying spout, wherein said body defines an inner conical partition wall through which an axial conduit is extended, the conduit having a valve seat at a bottom portion thereof, a top portion of the conduit being in fluid communication with a supplying orifice lying over a top surface of said conical partition wall and debauching outside the container through the supplying spout, the valve member being mounted against a bottom surface of the partition wall, the valve member comprising a conical circular membrane having at a center thereof a closing piece resiliently held in the membrane and sealing against the valve seat, the membrane being firmly retained between the partition wall and the socket, the socket being in turn retained between the body of the valve assembly and the neck of the container.

It is a further object of the present invention to provide a process for filling containers with pressurized liquid and obtaining a siphon bottle with pressurized liquid capable of being driven out of the container under the effect of the pressure within the container, the container comprising a valve assembly, a body capable of being sealably fixed to a neck of the container, a socket holding a dip tube extending to a bottom of the container and a valve member capable of being operated by an user to open a path for said liquid through the dip tube towards a supplying spout, wherein said body defines an inner conical partition wall through which an axial conduit is extended, the conduit having a valve seat at a bottom portion thereof, a top portion of the conduit being in fluid communication with a supplying orifice lying over a top surface of said conical partition wall and debauching outside the container through the supplying spout, the valve member being mounted against a bottom surface of the partition wall, the valve member comprising a conical circular membrane having at a center thereof a closing piece resiliently held in the membrane and sealing against the valve seat, the membrane being firmly retained between the partition wall and the socket, the socket being in turn retained between the body of the valve assembly and the neck of the container, the process comprising the steps of:

providing a container having an upper neck with an opening defining an access to an inner volume of the container;

filling the container with a gaseous liquid;

fixing said valve assembly onto the opening of the container neck, the valve assembly being assembled without the dome-cap;

injecting a pressurized gas through said axial conduit and against a resilient force of said closing piece to move said closing piece out of its valve seat, so as to bring the pressure within the container up to a value enough to drive the liquid, upon operating the valve assembly, out of the container through the dip tube and the supplying conduit; and fixing said dome-cap onto the body to close said top opening of the body.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 2:
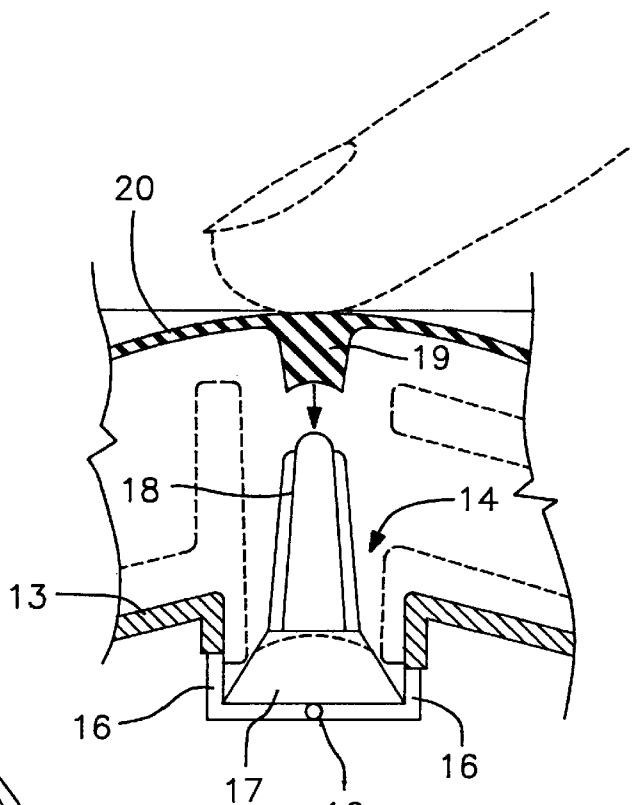
FIG. 2 shows an enlarged cross-sectional, side elevation view of the closing piece of the invention.
Figure 1:
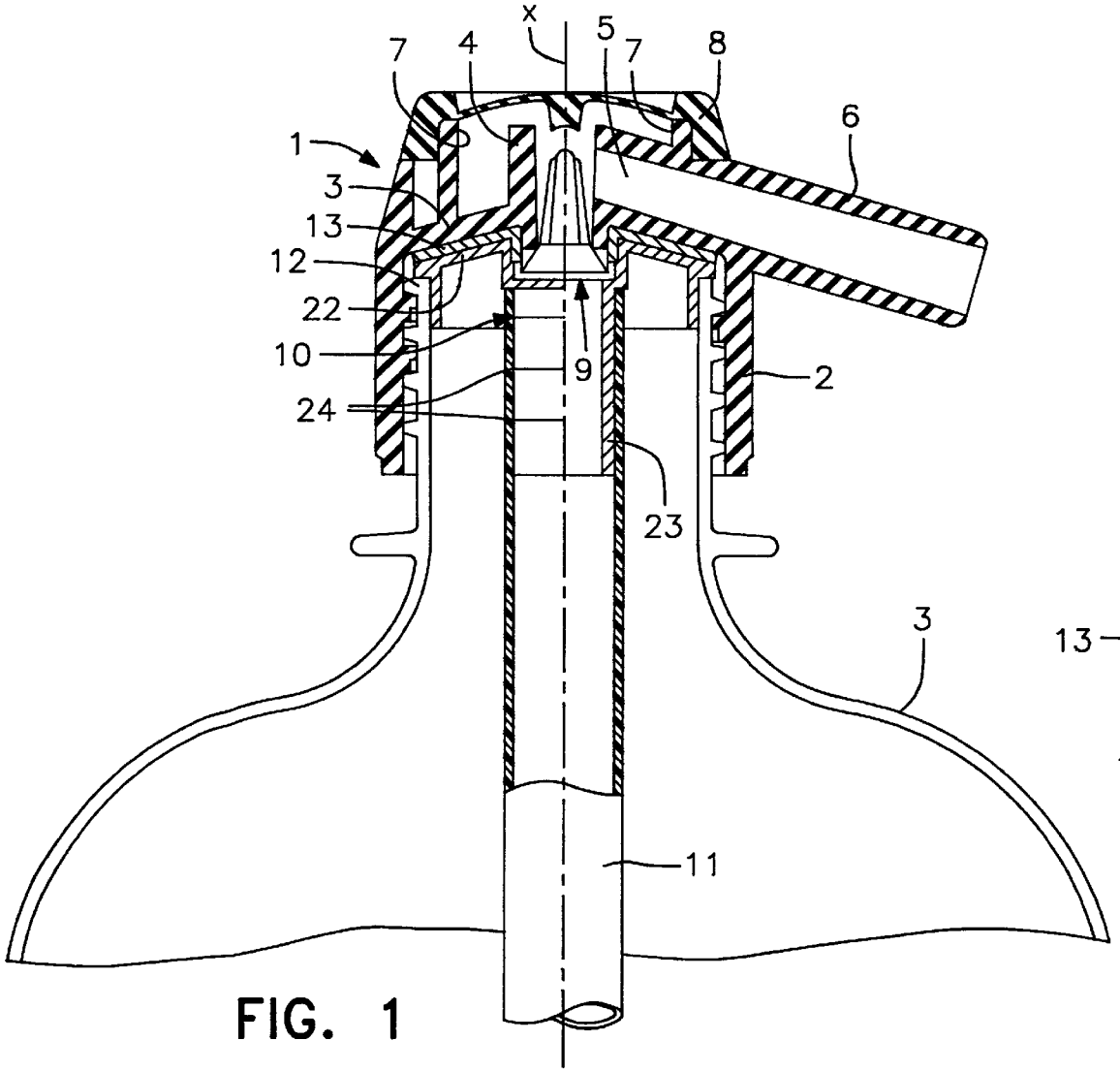
FIG. 1 shows a partially cross-sectional, elevation side view of the valve assembly according to the invention, fixed in a container of the type of a siphon bottle.

Now referring in detail to the drawings it may be seen from FIGS. 1 and 2, that the valve assembly of the invention, generally referenced with number 1, comprises a body 2 adapted to be threadably fixed in the neck of a bottle, preferably a PET made plastic bottle, very common for soda drinks. Body 2 has a transverse partition wall 3 having, at a center portion thereof, an axial conduit 4 communicating to a supplying orifice 5 for supplying the liquid from the bottle through a supplying spout 6. Body 2 has, at an upper pert thereof, a top opening 7 and a dome-cap 8 retained on and closing the opening.

A valve member 9 is mounted within the body and a dip tube 11 is retained within a tube-retaining socket 10, the dip tube hanging from the socket and downwardly extending through the pressurized liquid so that the liquid contained in the bottle can be driven out through the dip tube and controllably supplied out of the bottle through spout 6. Valve member 9 and socket 10 are firmly retained between the body of the valve assembly and the neck of the bottle, more precisely between partition wall 3 and an upper edge 12 of the bottle neck, so as to make the valve assembly and the bottle to form a sealed connection against any undesired leakage.

According with one of the main features of the invention, partition wall is conical relative to a longitudinal axis X of the valve assembly 1 and bottle. On an upper conical surface of wall 3 orifice 5 is arranged, preferably in communication to a lower portion of axial conduit 4, so that no dead spaces are defined over valve member 9, thus avoiding part of the supplied liquid to remain within the valve body without being duly supplied through the supplying spout. Thus, the common upper dead spaces, under dome-cap 8, are dramatically reduced to prevent liquid deposits and to put in practice a filling and/or refilling method to which reference will be made hereinafter. In addition, valve member 9 is easily accessible close to top opening 7 of body 2, and at a minimum distance from dome-cap 8 so as to be actuated from outside the valve assembly and through the dome-cap.

Valve member 9 is close to a lower surface of wall 3 and sealably connected to the wall, the valve member comprising a membrane-like disc 13 having, at a center part thereof (FIG. 2), a valve opening 14 defining a skirt from which a plurality of resilient vertical arms or bridges 16, preferably three bridges, are uniformly circumferentially arranged around opening 14. A closing piece 17 is fixed to bridges 16, piece 17 being conical shaped, preferably having a 30° conicity relative to an horizontal plane (not illustrated). Closing piece 17 has an actuating stem 18 at a central and top portion of the piece, the actuating stem having a top end facing an actuating projection 19 which has a wedging or nesting shape to couple against the top end of the stem upon pressing on a dome 20 of dome-cap 8, the actuating projection being integral to dome 20 and dome-cap 8. Dome 20 is construed as a resilient membrane capable of elastically yielding upon being pressed and actuated under the force of an user's finger, for example (FIG. 2). When pressed, dome 20 and more particularly actuating projection 19 push stem 18 downwardly so as to move closing piece 17 out from the valve seat at the bottom part of conduit 4 to drive the liquid contained in the container out of the container via dip tube 11 and supplying spout 6. Due to the resiliency of vertical arms 16 closing piece 17 is able to move downwards as well as to return to its position seated against the seat valve.

A tube-retaining socket 10 is airtight mounted in valve member 9, the socket having a conical disc portion 22 merging with a downwardly extending tube portion 23 which preferably has a plurality of gripping means 24 to retain dip tube 11 in a desired position. Tube 11 is mounted over an outer surface of tube portion 23 so as to make the mounting procedure easier and to avoid any pressure shock remove the dip tube out from the tube portion 23.

As may be seen from the drawings, partition wall 3, as well as membrane 13 and disc portion 22 are all conical and retained one against the other under the pressure exerted by body 2, when threaded on the bottle neck, against the top edge 12 of the neck, so as to be arranged in tight seating relationship. The conicity of these members, preferably between 20° and 30° relative an horizontal plane, causes the valve assembly to have no dead spaces above partition wall 3, at an upper part of the valve assembly, and valve member 9 to be close to top opening 7 of body 2, not only to facilitate actuation of stem 18 through projection 19 but also to carry out a novel process for filling or re-filling the container by means of conventional machines which, if necessary, may be slightly adjusted or modified by any person skilled in the art.

In accordance with another object of the invention, a process is provided to fill or re-fill a container with a liquid under pressure, provided that the container is fitted with a valve assembly as shown in FIGS. 1 and 2. As it was above explained, in the known procedures for filling siphon bottles, the inner volume of the bottle is not cleaned or washed as long as the valve assembly remains entirely fitted in the bottle during the filling or refilling steps. To conventionally fill a siphon bottle, the bottle is placed upside down and the supplying spout of the valve assembly is connected to a filling nozzle capable of supplying liquid under a pressure enough to cause the valve member of the assembly to open from the seat thereof and let the pressurized liquid enter the bottle. The pressure under which the liquid is supplied must be high not only to open the valve member but also to keep the liquid under a pressure enough to drive the liquid out of the bottle when operating the valve assembly. No mention to precise pressure values will be made as long as the pressure of the liquid will depend of the kind of gaseous water, the shape of the container, etc., in any case, the pressure to which reference is made along the present specification and claims will be that one enough to drive the water upwards via the dip tube and through the supplying spout in a way that the water is provided with a desirable flow and bubbles at the user's taste.

The process of the invention provides the steps for filling the container with a gaseous liquid as it is provided in the conventional plants for filling PET bottles in the soda industry (no siphon bottles), that is with conventional filling machinery without additional machines neither additional costs. Because the valve assembly of the invention is disposable the container is not refilled but subject to only one filling step, with the container previously completely washed. The container filled with the gaseous water is conveyed along a continuous line to a station wherein the valve assembly is fitted in the neck of the bottle without the dome-cap 8. That is, opening 7 remains open so as to provide access to axial conduit 4 and stem 18 of the closing piece. The container follows conveyed to another station wherein a filling head or nozzle (not shown because it may have a conventional configuration) injects an additional charge of gas under pressure, preferably $CO_2$, within the container and against the resilient force of valve member 9. Thus, the liquid within the bottle is under an overpressure enough to drive the liquid out of the container, via the dip tube, upon actuating over stem 18, through dome 20, as it shown in FIG. 2. Once the additional charge of gas has been provided into the container, and the closing piece has seated against the valve seat of conduit 4, the liquid remains overpressurized and the container is conveyed to another station wherein the dome-cap 8 is fitted to close opening 7. Thank to the fact that dome-cap 8 is simple, with a straightforward configuration, without inconvenient complex shapes, the same may be easily handled by means of conventional sorting and capping machines. This is a very important aspect to be taken into account in the industry related to bottling where capping is required, because the handling of complex-shaped caps makes the machines to be blocked by caps wedged in the guiding channels of the machines.

It is thus clear that the present invention not only provides for a novel valve assembly for pressurized liquid-containing containers but also a new method for filling or refilling such containers with gaseous liquid.

While a preferred embodiment of the present invention has been illustrated and described, it will be obvious to those skilled in the art that various changes and modifications may be made therein without departing from the scope of the invention as defined in the appended claims.

We claim:

1. A valve assembly for supplying pressurized liquid from a container, the assembly being of the type comprising a body capable of being sealably fixed to a neck of the container, a socket holding a dip tube extending to a bottom of the container to allow the liquid to be driven out by the pressure of the gas within the container and a valve member capable of being operated by an user to open a path for said liquid through the dip tube towards a supplying spout, wherein said body defines an inner conical partition wall through which an axial conduit is extended, the conduit having a valve seat at a bottom portion thereof, a top portion of the conduit being in fluid communication with a supplying orifice lying over a top surface of said conical partition wall and debauching outside the container through the supplying spout, the valve member being mounted against a bottom surface of the partition wall, the valve member comprising a conical circular membrane having at a center thereof a closing piece resiliently held in the membrane and sealing against the valve seat, the membrane being firmly retained between the partition wall and the socket, the socket being in turn retained between the body of the valve assembly and the neck of the container.

2. The valve assembly of claim 1, wherein said axial conduit upwardly extends close to a top opening of the body, said closing piece having, at a central upper part thereof, an upwardly vertically extended stem running within said axial conduit and extending close to said top opening of the body.

3. The valve assembly of claim 2, wherein said stem of the closing piece has a top end facing an actuating projection of a dome-cap closing said top opening of the body.

4. The valve assembly of claim 3, wherein said actuating portion of the dome-cap comprises a recessed pin for receiving the top end of the stem.

5. The valve assembly of claim 1, wherein said supplying orifice communicates to said axial conduit at a lower portion of the conduit so that the axial conduit and an upper portion of the body do not define liquid-retaining dead spaces.

6. The valve assembly of claim 1, wherein said closing piece is resiliently held in said membrane by means of at least three resilient vertical bridges.

7. The valve assembly of claim 1, wherein said partition wall, said membrane and said socket have a 20° conicity.

8. The valve assembly of claim 1, wherein said closing piece comprises a conical piece having a 30° conicity.

9. A process for filling containers with pressurized liquid and obtaining a siphon bottle with pressurized liquid capable of being supplied under the effect of the pressure within the container, the container comprising a valve assembly according to claim 1, wherein the process comprises the steps of:

providing a container having an upper neck with an opening defining an access to an inner volume of the container;

filling the container with a gaseous liquid;

fixing said valve assembly onto the opening of the container neck, the valve assembly being assembled without the dome-cap;

injecting a pressurized gas through said axial conduit and against a resilient force of said closing piece to move said closing piece out of its valve seat, so as to bring the pressure within the container up to a value enough to drive the liquid, upon operating the valve assembly, out of the container through the dip tube and the supplying conduit; and fixing said dome-cap onto the body to close said top opening of the body.

* * * * *